United States Patent [19]

Sava

[11] 4,304,019

[45] Dec. 8, 1981

[54] TOOL FOR CLOSING AND OPENING BUCKLES ON SKI BOOTS

[76] Inventor: Gerard A. Sava, Nathan Hale Dr., Stamford, Conn. 06902

[21] Appl. No.: 43,175

[22] Filed: May 29, 1979

[51] Int. Cl.[3] ..... B25F 1/00

[52] U.S. Cl. ..... 7/170; 81/3 R; 254/131; 280/816

[58] Field of Search ..... 81/3 R, 3.34, 3.46; 7/170; 254/131; 280/11.37 T, 809–816; 74/544

[56] References Cited

U.S. PATENT DOCUMENTS

| | | | |
|---|---|---|---|
| 1,389,477 | 8/1921 | Beeman | 81/3 R |
| 2,473,158 | 6/1949 | Luekens | 280/11.37 T |
| 2,641,939 | 6/1953 | McKee | 81/3 R |
| 3,864,769 | 2/1975 | Hamilton | 81/3 R |

*Primary Examiner*—Roscoe V. Parker

*Attorney, Agent, or Firm*—St. Onge, Steward, Johnston, Reens & Noe

[57] ABSTRACT

A tool for closing and opening buckles on ski boots comprising a body having a cavity including first and second spaced apart surfaces and being open at one end of the body to receive a buckle, the tool having an elongated lever attached to the body and extending in a direction generally opposite to the open end of the cavity.

6 Claims, 8 Drawing Figures

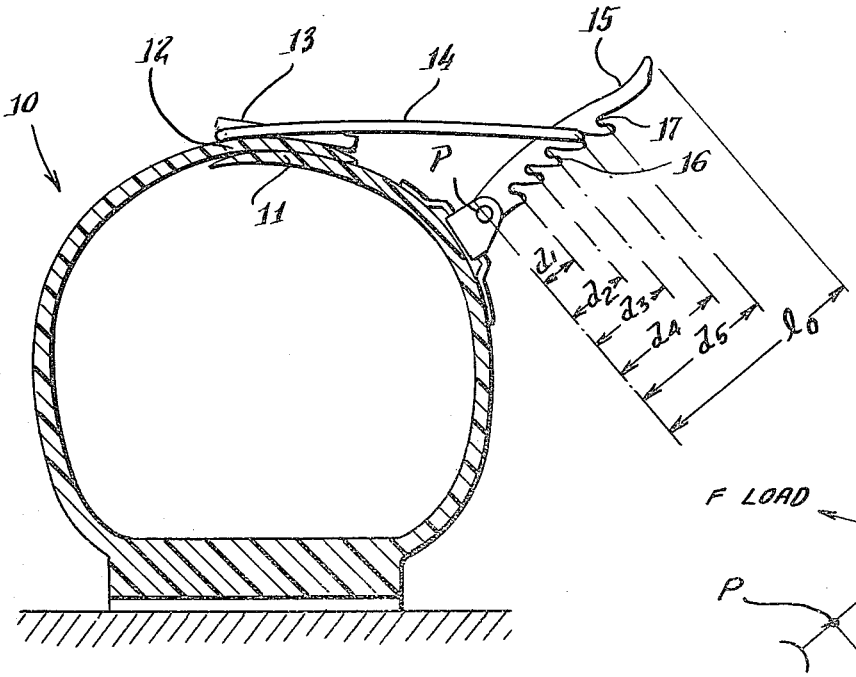
Fig. 1.
Fig. 1A
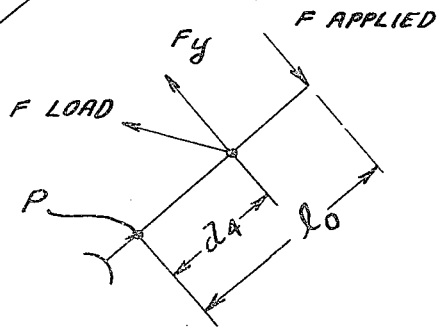
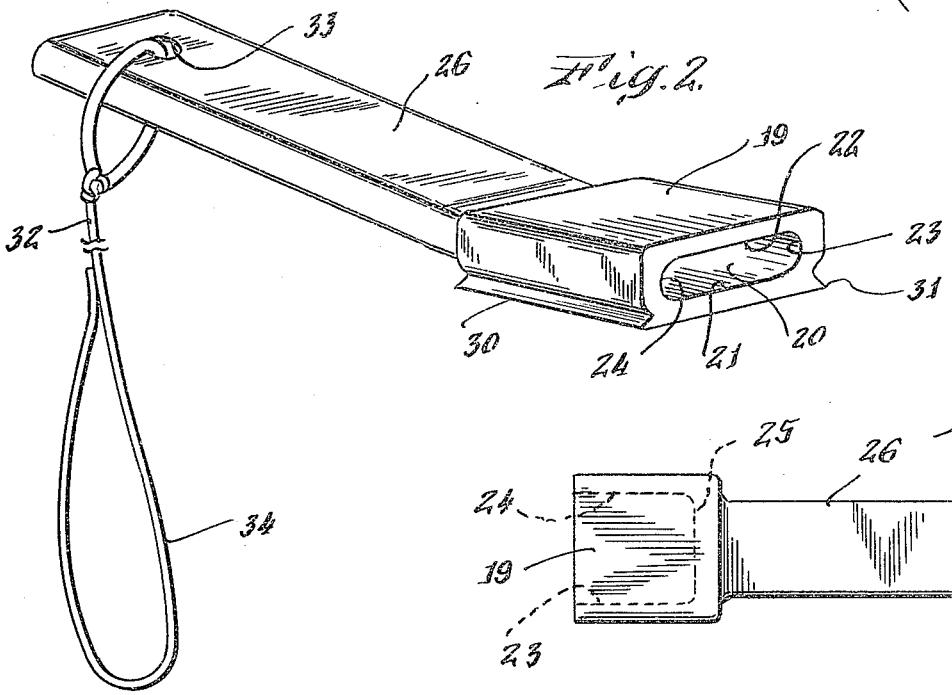
Fig. 2.
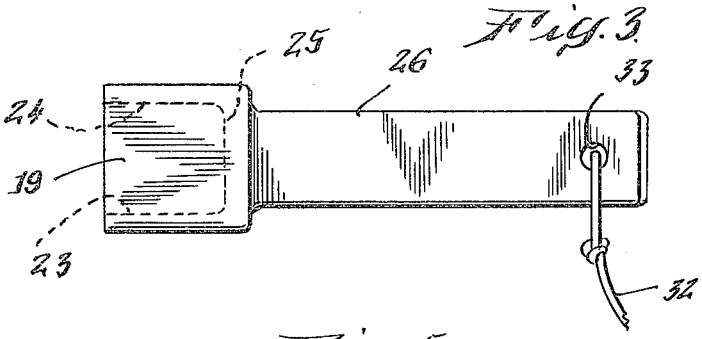
Fig. 3.
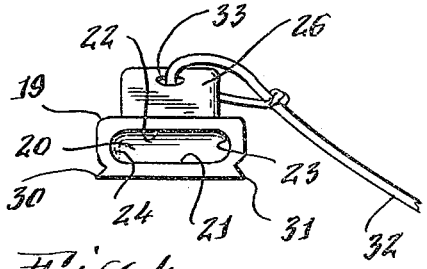
Fig. 4.
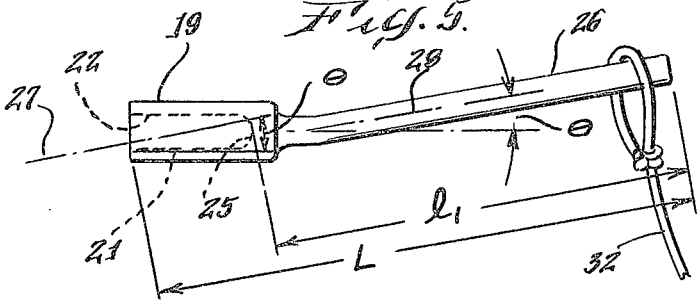
Fig. 5.

TOOL FOR CLOSING AND OPENING BUCKLES ON SKI BOOTS

BACKGROUND OF THE INVENTION

1. Field of the Invention

The present invention relates to a tool for opening and closing the buckles on ski boots.

2. Description of the Prior Art

A conventional ski boot including a pivotal buckle is shown in a schematic sectional view in FIG. 1. A conventional ski boot typically includes a plurality of buckles, only one being shown in side view in FIG. 1. The ski boot includes an outer shell 10 including an outer half 11 and an instep half 12, instep half being slideable in relation to outer half 11 to provide for adjustment of the tightness of the boot on the foot of the skier. The interior parts of the ski boot such as the bladder and the lining are omitted to simplify the drawing. The instep half 12 of shell 10 includes an anchor 13 extending therefrom which provides for securement of one end of a strap 14. Strap 14 typically has the shape of an elongated loop and is made from twisted wire strands and which is, in part, coated with plastic. Buckle 15 has a generally elongated shape and is pivotal about axis P. The intermediate portion of buckle 15 includes a plurality of teeth 16 defining gaps 17 therebetween. The second end 18 of strap 14 may be releasably positioned within the gaps between the teeth. The tightness of the boot will be determined by the gap in which the second end of strap is positioned. For example, if the end 18 of strap 14 is positioned in the gap a distance of $d_1$ from the pivot axis P, the boot will be relatively loose because instep half 12 of shell 10 slides a relatively small distance in relation to outer half 11 when the buckle is pivoted clockwise to the closed position. As the distance between the gap in which strap 14 is positioned and the pivot axis P is increased, the tightness of the boot is increased.

During the time a skier is skiing downhill, it is desirable to have the buckles on the ski boots at relatively tight settings. Generally speaking, the tighter the buckles, the less movement between the skier's foot and the skier's boot and the more control the skier will have over the skis. As the ski boot is tightened, pressure is imposed upon the foot of the skier, and the pressure may result in discomfort to the skier. A skier typically tightens his boots just prior to beginning a downhill run. When the skier reaches the bottom of the mountain, the buckles may be loosened to provide for comfort during the ride up the mountain. Thus, during the course of a day, a skier may open and close the buckles on the ski boots on numerous occasions.

Referring to FIG. 1A which is a force diagram for the buckle shown in FIG. 1, as the skier seeks to tighten the buckles further by positioning the end of strap 14 in a gap further away from pivot axis P, the force, $F_{applied}$, required to close the buckle increases. The increasing force is due to at least two factors. Firstly, in order to slide instep half 12 with respect to outer half 11 a relatively large distance to tighten the boot, the resistance of movement of the halves with respect to each other is relatively large and must be overcome: as shown in FIG. 1A, the y component of the load force, Fy, increases. Secondly, as the distance between the pivot axis P and the gap in which the end 18 of strap 14 is placed increases, the mechanical advantage or leverage to the skier decreases. For example, referring to FIG. 1A, the movement about axis P in the clockwise direction must exceed the moment in the counterclockwise direction. Thus, the following inequality would apply:

$$F_{APPLIED} > (Fy\ d)/l_0$$

In the above equation, $l_0$ is the distance at which the force is applied by the skier. d is one of the distances ($d_1$, $d_2$, $d_3$, $d_4$ or $d_5$) at which the y component of the load force, $F_y$, is applied. Since $l_0$ is constant, as the distance, d, between the pivot axis, P, and the gap in which the strap is positioned increases, the force applied to overcome the poor leverage must also increase. Thus, in order to close the buckle, to a tight setting, the skier is faced with problems of decreased mechanical advantage and an increased force load which must be overcome. As can be appreciated, the buckle becomes very difficult to buckle as the desired tightness of the boot increases.

In order to tighten the ski boots to a relatively high degree, a skier may position the strap in a gap which is close to the pivot axis P. The skier will close the buckle with relative ease and then open the buckle and move the strap to a gap located a further distance from the pivot axis. This process is repeated until the desired tightness of the boot is reached. It should be understood that this process of tightening the boots is considered by some to be a difficult task since it requires the skier to bend over and push the buckle downwardly. The difficulty of buckling the boot is exacerbated because the buckling is typically done in a harsh environment such as at the top of a mountain after getting off the ski lift or tram. Moreover, each boot will typically include at least two buckles and often four or five buckles.

Once again referring to FIG. 1, the skier grasps the end portion of the buckle and pivots the buckle in a clockwise direction from the position shown in FIG. 1. When the buckle reaches a position wherein the strap 14 is in alignment or coincides with the pivot axis P, the buckle tends to snap or pivot quickly and with a great deal of force toward the boot. It is not unusual for a skier to catch his finger between the buckle and the boot. The force on the buckle may be such that the skier's fingers are bruised or cut.

It is an object of the present invention to provide a tool for opening and closing buckles on ski boots. More particularly, it is an object of the present invention to provide a tool which reduces the effort required by the skier to open and close the buckles on ski boots.

SUMMARY OF THE INVENTION

The present invention provides a tool which reduces the effort needed to open and close the buckles on a ski boot. The tool comprises a body including a cavity which is defined by at least two spaced apart surfaces and which is open at one end of the body to provide for insertion of the buckle. The body is preferably generally rectangular in shape and the cavity is preferably bounded on five sides by walls to define a generally rectangular cavity and is open at one end to receive the buckle. The tool further includes an elongated lever arm which is attached to the body and which extends in a direction opposite to the open end of the cavity. In order to use the tool, the skier inserts the buckle into the cavity. Preferably, the cavity is sufficiently deep to allow the cavity to encompass at least two strap positioning gaps on the extremities of the buckle. Thus, when the strap is positioned in a gap which will provide for a relatively tight setting of the boot, the encompassing cavity reduces or eliminates the possibility of the strap slipping out of the gap when the buckle is being closed. In order to close the buckle, the lever arm is grasped by the skier and moved in one direction to provide for engagement of the end portion of the buckle by the first surface and the intermediate portion of the buckle by the second surface to pivot the buckle toward the closed position. As the buckle is moved toward its closed position, the buckle reaches a position wherein the strap is in line with the pivot axis of the buckle. At this "over center" point, the buckle tends to snap quickly and with a great deal of force toward the side of the ski boot. Because the skier grasps only the lever arm and the skier's hand is not in the vicinity of the buckle, the possibility of the skier's hand being injured by the closing buckle is eliminated. Thus, the tool for buckling ski boots not only provides for increased mechanical advantage for the skier, but also, reduces the likelihood of injury to the skier.

In a preferred embodiment of the invention, the two surfaces which, at least in part, define the cavity, are planar and extend in parallel relation to define a generally rectangular cavity. Preferably, the longitudinal axis of the elongated lever arm is in angular relation to the planar surfaces which define the cavity. It should be understood that the buckle fits loosely within the cavity so that when the buckle is inserted within the cavity and the lever arm is pushed downwardly during closing of the buckle, the end portion of the buckle is engaged by the first or top surface of the cavity in deeper regions of the cavity. The intermediate portion of the buckle is engaged by the second or bottom surface of the cavity in the region of the cavity near the opening. In order to gain maximum mechanical advantage for the lever arm, the longitudinal axis of the lever arm should extend in parallel relation to the longitudinal axis of the buckle. However, when the buckle is being closed, the longitudinal axis of the buckle is in angular relation to the top and bottom surfaces of the cavity. In order to compensate for this angular relation between the longitudinal axis of the buckle and the surfaces of the cavity, the longitudinal axis of the lever arm is angled in relation to the surfaces defining the cavity. Moreover, this angular relation provides for ease of insertion of the buckle into the cavity when the buckle is in the closed position and the buckle abuts the ski boot. For example, when the buckle is closed and the skier desires to open the buckle, the angular relation of the lever arm allows the lower wall of the cavity to be pried between the buckle and the boot with relative ease.

Although the tool of the present invention is intended to be used primarily for opening and closing the buckles on a ski boot, it should be understood that the tool may be modified to serve additional purposes. For example, in a case where the body of the tool is generally rectangular, the exterior walls of the body may be shaped to provide at least one and generally two edges for removing snow from the bottom of the ski boot. Moreover, a strap may be attached to the end of the lever arm and may include a loop for receiving the release arm of a conventional step-in binding. Thus, the skier may grasp the tool in the region of the cavity and insert the release arm of the binding into the loop. The tool may be pulled upwardly to release the ski boot from the binding. Additional advantages of the tool of the present invention will be apparent from the following detailed description of the invention with reference to the drawings.

BRIEF DESCRIPTION OF THE DRAWINGS

FIG. 1 is a schematic sectional view of a ski boot and a side view of a pivotal buckle for tightening the ski boot;

FIG. 1A is a force diagram for the buckle shown in FIG. 1;

FIG. 2 is a perspective view of a tool for opening and closing buckles on ski boots;

FIG. 3 is a top plan view of the tool shown in FIG. 2;

FIG. 4 is a front plan view of the tool shown in FIGS. 2 and 3;

FIG. 5 is a side plan view of the tool shown in FIGS. 2, 3 and 4;

FIG. 6A is a force diagram for the buckle and tool shown in FIG. 6.

DETAILED DESCRIPTION OF THE INVENTION

Figure 6:
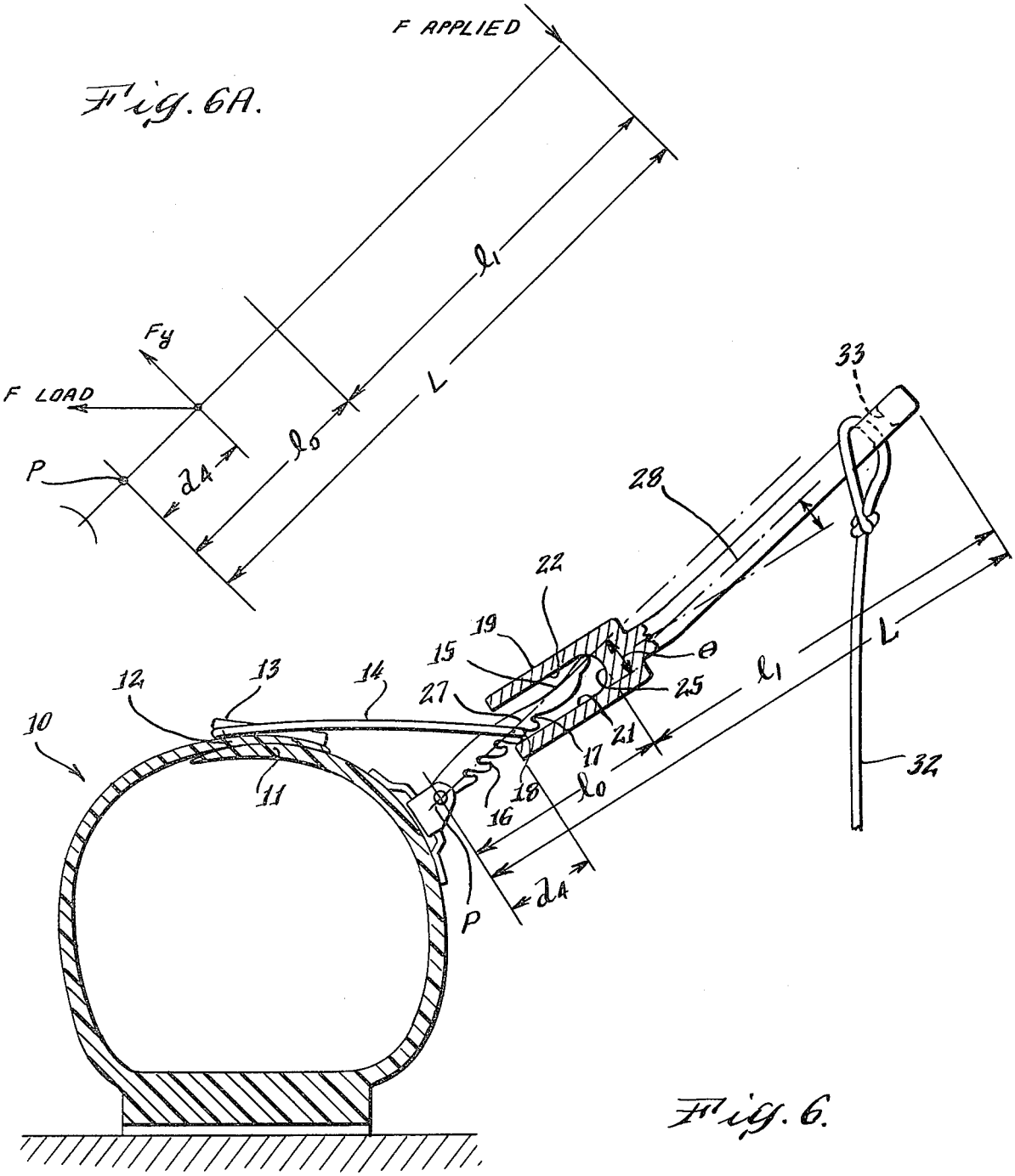
FIG. 6 is a view of the ski boot and ski boot buckle corresponding to FIG. 1 and in addition including a side plan view of the tool shown in FIGS. 2–5 being used to close the buckle, a portion of the tool being shown in sectional view.

Referring simultaneously to FIGS. 2, 3, 4 and 5, the tool for opening and closing ski boots is shown. The tool includes a body 19 having a generally rectangular shape. The body includes a cavity 20 defined by a lower surface 21 and upper surface 22, two interior sides 23 and 24 and a rear wall 25. Cavity 20 is open at one end of the body and has a generally rectangular shape.

An elongated lever arm 26 is attached to the body 19 at the end of the body opposite the opening of the cavity. Preferably, lever arm 26 and body 19 are integral and the entire tool is formed from cast aluminum or other relatively rigid material.

Referring in particular to FIG. 6, the manner in which the tool is used is shown. The ski boot and the buckle have been described previously. Buckle 15 is in the open position and end 18 of strap 14 is in a gap 17 spaced a distance $d_4$ from the pivot axis P of the buckle. The end of the buckle has been inserted within cavity 20. Preferably, cavity 20 has a depth sufficient to span at least two teeth and two corresponding gaps on the underside of the buckle. As clearly shown in FIG. 6, when the buckle is inserted into cavity 20, bottom surface 21 prevents the end 18 of strap 14 from slipping out of the gap between the teeth. Also as shown in FIG. 6, the buckle fits loosely within cavity 20 so that there is a predetermined amount of "play" between the buckle and surfaces 21 and 22 of the cavity. This allows the tool to be used on most conventional pivotal buckles used with ski boots. In order to pivot the buckle from the open position shown in FIG. 6 toward the closed position, the skier grasps lever arm 26 and pushes the lever arm downwardly to rotate the buckle in a clockwise direction about pivot axis P. The end portion of the buckle is engaged by the upper surface 22 in the region of the deepest portion of the cavity. The intermediate portion of the buckle is engaged by lower surface 21 of the cavity. As shown in FIG. 6, surfaces 21 and 22 are planar and extend in parallel relation. Since there is a predetermined amount of "play" between the buckle and the surfaces 21 and 22 of the cavity, when the buckle is being closed, the longitudinal axis of the buckle is in angular relation to the surfaces 21 and 22 of the cavity. In order to gain maximum mechanical advantage or leverage for the skier using the tool for closing the buckle, it would be desirable for the longitudinal axis of the lever arm to extend in parallel relation to the longitudinal axis of the buckle. In order to accommodate for the angular relation between the longitudinal axis of the buckle and surfaces 21 and 22, the longitudinal axis of lever arm 26 is in angular relation with respect to the surfaces 21 and 22. Referring to FIG. 5, the longitudinal axis of the buckle is shown by reference character 27 and the longitudinal axis of the lever arm is shown by reference character 28. It is desirable for the longitudinal axis 27 of the buckle to extend in approximately parallel relation to the longitudinal axis of the lever arm. The angle, $\theta$, between the longitudinal axis of the lever arm and the surfaces 21 and 22 will depend upon the size of the cavity and the size of the buckle. Generally speaking, it is preferable that $\theta$ be between about 15 and 25 degrees, most preferably 20 degrees. In addition to providing maximum mechanical advantage, the angular relation between the lever arm 26 and the body 21 allows for easy opening of a closed buckle. In order to open a closed buckle, lower wall 29 must be pried between the buckle and the boot.

Referring to FIG. 6A which is a force diagram for the buckle and tool shown in FIG. 6, the increased mechanical advantage for buckling the ski boot is illustrated. It should be recalled that the force required to be applied without the tool is in accordance with the following constraint equation:

$$F_{Applied} > (Fy\ d)/l_o$$

With the use of the tool shown in FIG. 6, the force required to be applied is as follows:

$$F_{Applied} > (Fy\ d)/(l_o + l_1)$$

The ratio of the force required to be applied without the tool and with the tool is approximately:

$$\frac{F_{Applied\ without\ tool}}{F_{Applied\ with\ tool}} = \frac{l_0}{l_0 + l_1}$$

Thus, the mechanical advantage is increased significantly. For example, when the effective length $l_1$ of lever arm 26 is twice the length, $l_o$, of buckle 15 the force necessary to close the buckle is reduced by approximately one third.

To increase the tightness of the boot, the strap is positioned in a gap located a farther distance, d, from the pivot axis, P, of the buckle. As this distance, d, is increased, the y component of the load force, Fy, also increases. The movement about axis P which must be overcome to close the buckle increase in proportion to the use of the tool of the present invention, the relatively large moment, Fy×d, had to be overcome by applying force, $F_{applied}$, at a distance, $l_o$, which was not much greater than the distance, d, at which Fy was applied. The tool of the present invention reduces significantly the amount of force required to be applied to generate a moment which is larger than Fy×d. By increasing the distance at which the force, $F_A$, is applied by an increment of $l_1$, a moment sufficient to overcome the moment Fy×d is generated with reduced effort by the skier.

Use of the tool of the present invention also reduces the possibility that a skier's finger will be caught between the buckle and the boot when the buckle snaps to the closed position. It should be recalled that when the buckle is being closed without the aid of the tool of the present invention, when the strap 14 is in alignment with pivot axis P of buckle 15, the buckle tends to snap quickly and with a great deal of force toward the boot and a skier's finger may get caught between the buckle and the boot. When the skier uses the tool, the risk of injury to the skier's fingers when the buckle is being closed is reduced substantially.

Although the tool of the present invention is designed primarily for use in opening and closing buckles of ski boots, it should be understood that the tool may serve other purposes. For example, as best shown in FIGS. 2 and 4, the two bottom edges of the body may be sharpened to allow for use of the tool to scrape snow from the bottom of ski boots. Removal of snow from the bottom of ski boots is particularly useful just prior to inserting the ski boot into a conventional ski binding. It is preferable that edges 30 and 31 be shaped so that they do not protrude from the vertical face of the sidewalls of body 19 to reduce the likelihood of the skier falling on the tool and being cut by the scraping edges 30 and 31. Each of the vertical sidewalls includes an elongated groove adjacent the edges 30 and 31, the grooves providing for sharpened edges 30 and 31 which are positioned at or inwardly of the planes of the vertical sidewalls to reduce the possibility of injury to the skier.

A strap 32 may be attached to the end of lever arm 26. Strap 32 has one end attached to lever arm 26 through a hole 33 in the lever arm and the other end of strap 32 includes a loop 33. Strap 32 may be made from a flexible material such as leather or plastic. The skier may use the tool to open bindings by grasping the body 19 of the tool and engaging loop 33 with the release arm of a step-in binding. By pulling upwardly on strap 32, the release arm is moved to release the skier's boot from the binding. By providing a relatively long strap 32, the extent to which the skier must bend over to release binding is reduced. It should be understood that other types of tools may be incorporated or associated with the tool previously described. For example, the end of lever arm 26 may be shaped like a screwdriver or, the lever arm 26 may be hollowed to provide a space for the storage of additional tools.

It should be understood that although a specific embodiment of the invention has been described herein in detail, such description is for purposes of illustration only and modifications may be made thereto by those skilled in the art within the scope of the invention.

What is claimed is:

1. A tool for opening and closing buckles on ski boots of the type having at least one pivotal buckle, the pivotal buckle including an end portion and an intermediate portion and being pivotal about a pivot axis, said buckle including a plurality of teeth and a plurality of gaps therebetween, said teeth and said gaps extending along the longitudinal axis of the buckle, the tool comprising a body having a cavity including first and second spaced apart surfaces and being open at one end of the body to allow for insertion of the buckle, said body having a generally rectangular shape including a top wall, two vertical side walls, and a bottom wall defining two edges, each of said side walls including an elongated groove adjacent said edges to provide sharpened edges positioned at or inwardly of the planes of the vertical side walls, elongated lever means being attached to said body and extending in a direction generally opposite to said open end of said cavity, said cavity having a depth sufficient to span at least the two end teeth and the two end gaps on the buckle, said elongated lever means being movable in one direction to provide for engagement of said end portion of the buckle by the first surface and the intermediate portion of the buckle by the second surface to pivot the buckle in a first direction toward the closed position of the buckle, said lever means being movable in a second direction to provide for engagement of the end portion of the buckle by said second surface and said intermediate portion of the buckle by said first surface to pivot the buckle in a second direction toward the open position of the buckle.

2. A tool according to claim 1 wherein said first and second surfaces are generally planar and extend in parallel relation and wherein said elongated lever means defines a longitudinal axis, the longitudinal axis of the lever means being in angular relation to said first and second surfaces.

3. A tool according to claim 1 wherein the angle between said longitudinal axis of said lever means and said surfaces is between about 15 and about 25 degrees.

4. A tool according to claim 1 and further including a strap attached to the elongated lever means of said tool, said strap having a loop at one end thereof.

5. A tool for opening and closing buckles on ski boots of the type having at least one pivotal buckle, the pivotal buckle including an end portion and an intermediate portion and being pivotal about a pivot axis, said buckle including a plurality of teeth having teeth ends and a plurality of gaps therebetween, said teeth and said gaps extending along the longitudinal axis of the buckle, the tool comprising:

body means having a cavity including first and second spaced apart surfaces, said cavity being open at one end of said body means and having a depth sufficient for the cavity to encompass the two end teeth and two end gaps on the buckle, said body having a generally rectangular shape including a top wall, two vertical side walls, and a bottom wall, said two side walls and said bottom wall defining two edges, each of said side walls including an elongated groove adjacent said edges to provide sharpened edges positioned at or inwardly of the planes of the vertical side walls;

elongated lever means attached to said body means and extending in a direction generally opposite to said open end of said cavity; and one of said cavity surfaces contacting the end portion of said buckle and the other of said cavity surfaces contacting at least one tooth end at the intermediate portion of said buckle to pivot the buckle when said elongated lever is actuated to close the buckle.

6. A tool according to claim 5 wherein the longitudinal axis of said buckle, when inserted into said cavity, is in angular relation to said first and second surfaces, and wherein said elongated lever means has a longitudinal axis and is attached to said body means in angular relation to said first and second surfaces, said longitudinal axis of said buckle extending in generally parallel relation to the longitudinal axis of said elongated lever to provide for substantially maximum leverage.

* * * * *